United States Patent [19]

Sano

[11] 4,112,610

[45] Sep. 12, 1978

[54] TOY GARAGE

[75] Inventor: Hiroshi Sano, Tokyo, Japan

[73] Assignee: Tomy Kogyo Co., Inc., Tokyo, Japan

[21] Appl. No.: 776,780

[22] Filed: Mar. 11, 1977

[30] Foreign Application Priority Data

Mar. 12, 1976 [JP] Japan ..... 51-30123
Apr. 6, 1976 [JP] Japan ..... 51-38931

[51] Int. Cl.[2] ..... A63H 33/00
[52] U.S. Cl. ..... 46/12; 46/202
[58] Field of Search ..... 46/116, 11, 1 R, 202, 46/248, 39, 12

[56] References Cited

U.S. PATENT DOCUMENTS

| | | | |
|---|---|---|---|
| 2,817,924 | 12/1957 | Schrader | 46/202 X |
| 3,281,985 | 11/1966 | Einfalt | 46/202 |
| 3,457,668 | 7/1969 | Genin | 46/12 |
| 3,483,653 | 12/1969 | Genin | 46/12 |
| 3,593,454 | 7/1971 | Einfalt | 46/248 X |
| 3,789,538 | 2/1974 | Spengler et al. | 46/202 X |

*Primary Examiner*—Louis G. Mancene
*Assistant Examiner*—Mickey Yu
*Attorney, Agent, or Firm*—Staas & Halsey

[57] ABSTRACT

A toy garage having a cabinet provided with a plurality of compartments therein, a carrier for transporting vehicles mounted to move up and down and from side to side, and a control system including a plurality of actuating members for operating the carrier.

6 Claims, 12 Drawing Figures

TOY GARAGE

BACKGROUND AND SUMMARY OF THE INVENTION:

The present invention relates generally to a toy garage which is provided with a plurality of compartments for storing vehicles and a carrier for transporting the vehicles to and from the compartments. More particularly, the carrier is moved up and down by a first rod that terminates in gear wheels which move along racks provided within the device, and is moved from side to side by a second rod which also is provided with gear wheels which move along racks. The first and second rods are positioned horizontally and vertically, respectively, and offset from each other such that the carrier may be moved up and down, from side to side, and with composite movements. Four separate actuating members are employed, each of which moves the carrier in one direction. The actuating members are connected through gear trains to flexible bands which are mounted for sliding movement within the device. The bands mesh with gears of the trains thus translating the rotation of the gears to sliding movement of the bands and the rods attached thereto. Each of the gear trains is responsible for permitting the motor to rotate the gears in opposite directions, when desired, and includes as an integral part thereof a gear wheel which is mounted to move between two separate positions within the train in response to movement of the actuating members.

DESCRIPTION OF THE PREFERRED EMBODIMENT

Figure 1:
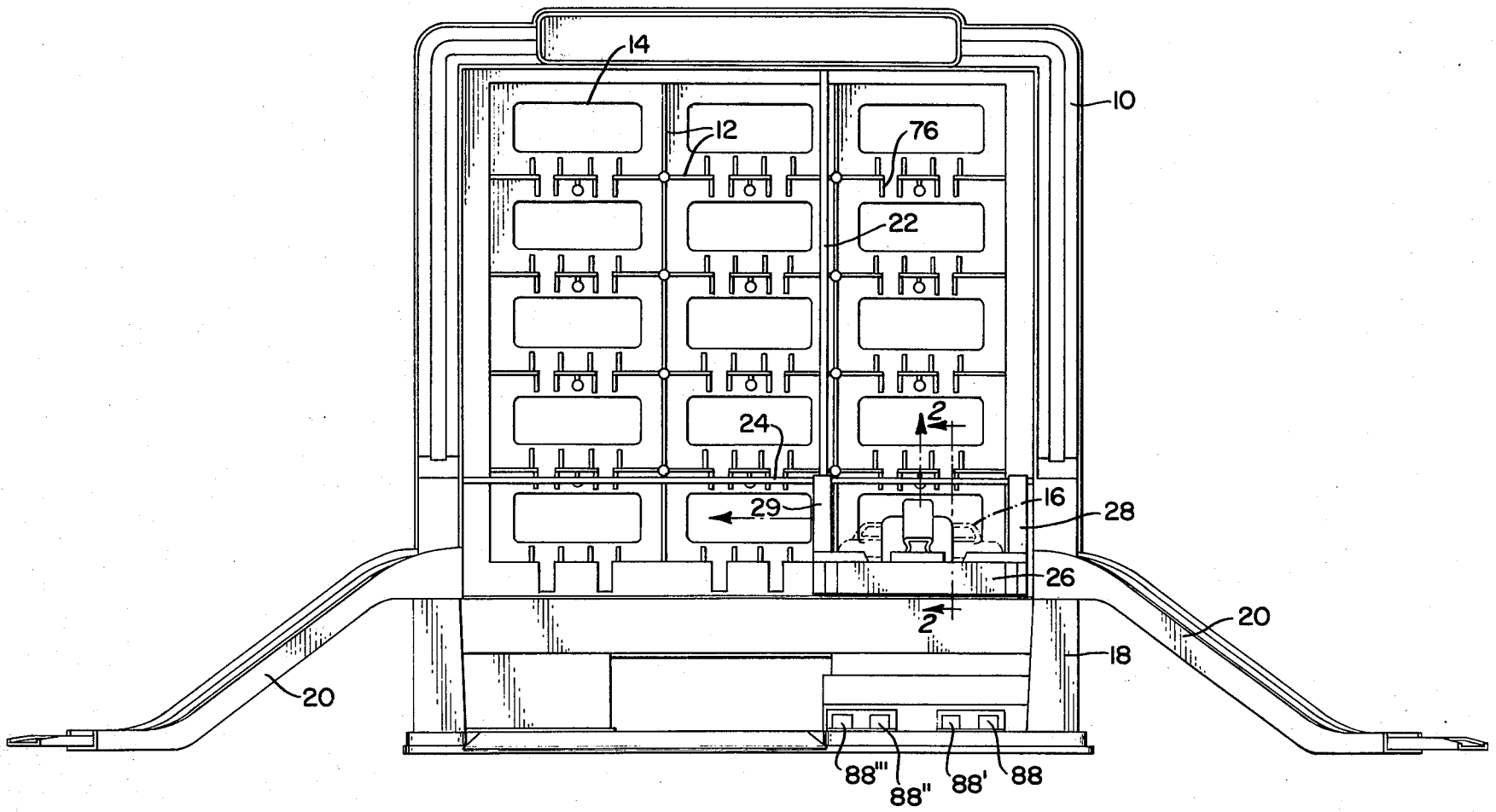
FIG. 1 is a front elevational view of the toy garage of the present invention, illustrating the cabinet which is provided with a plurality of compartments for storing the vehicles, the carrier for transporting the vehicles to and from the compartments, and the ramps leading to and from the carrier.

The toy garage of the present invention, as illustrated in FIG. 1, consists of a cabinet 10 provided with a plurality of intersecting walls 12 defining therebetween compartments 14 within which the vehicles 16 are stored. The cabinet 10 is mounted on a base 18 which is provided at each end thereof with a ramp 20. The rod 22 is mounted to move from side to side along the cabinet 10 while the rod 24 is mounted to move up and down with respect to the cabinet 10, as described hereinafter. An elevator 26 provided with upstanding arms 28 and 29 is supported by the rods 22 and 24, it being apparent from FIGS. 2 and 5 that the rod 24 passes through openings 25 provided within the arms 28 and 29, and the rod 22 passes through an opening 27 provided in the arm 29 which is offset from the openings 25 through which the rod 24 passes. As described hereinafter, the toy garage is provided with a mechanism wherein the rods 22 and 24 may be moved separately or simultaneously for the purpose of moving the elevator 26 into position adjacent any of the compartments 14 for depositing and removing the vehicle 16 from any of the compartments 14.

Figure 5:
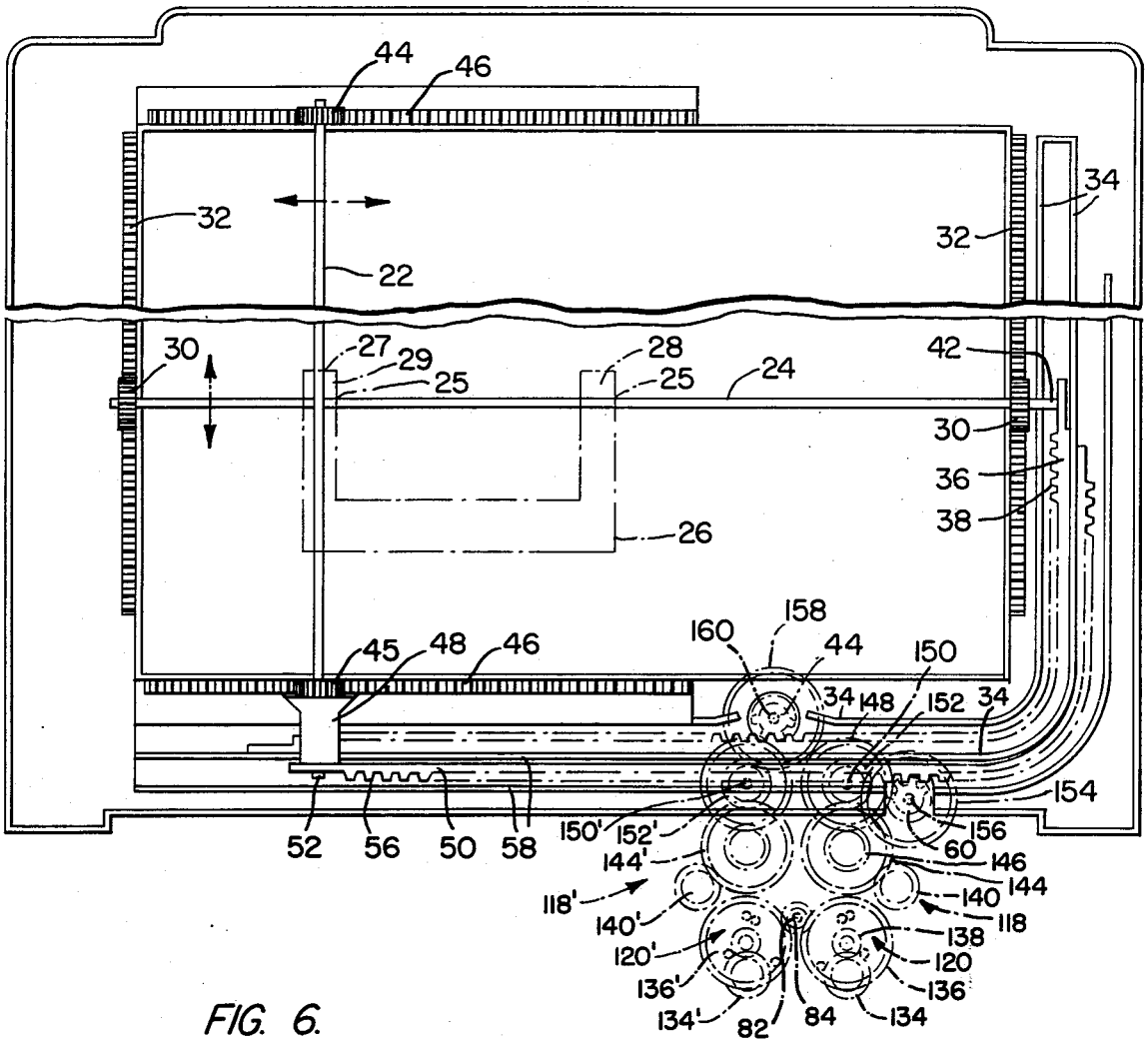
FIG. 5 is a front elevational view of the toy garage with a portion of the casing thereof removed exposing the rods which pass through the carrier and which are provided at each end with gear wheels which mesh with continuous racks of teeth, the continuous bands which connect the rods to rotating gear wheels which mesh with racks of teeth formed along the bands, and the two gear trains for rotating the gear wheels.
Figure 9:
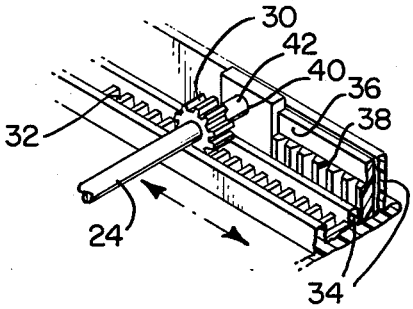
FIG. 9 is a perspective view illustrating one end of the horizontally positioned rod which is provided with a gear which meshes with a rack of teeth provided in the garage, and the flexible band attached thereto which is provided with a rack of teeth which mesh with a different rotating gear wheel for purposes of moving the rod and the carrier attached thereto.

Turning now to FIG. 5, which illustrates the cabinet 10 with a portion thereof removed so as to illustrate the operating mechanisms, it will be apparent that the rod 24 is provided at each end thereof with a gear wheel 30 fixedly secured thereto. The gear wheels 30 engage continuous racks of teeth 32 provided within the cabinet 10 so as to permit the rod 24 to move up and down the cabinet 10. The cabinet 10 is provided with upstanding walls 34 defining therebetween an area within which a flexible band 36 is mounted for movement. As illustrated in FIG. 9, the flexible band 36 is provided on the inner surface thereof with a rack of teeth 38 and at the end thereof with an opening 40 into which the end 42 of the rod 24 passes. Thus, as the gear wheel 44 rotates as described hereinafter the teeth thereof mesh with the teeth of the rack 38 causing the band 36 to move within the compartment defined by the walls 34, in turn causing the rod 24 to move as the gear wheels 30 thereof engage and move along the racks 32.

Figure 8:
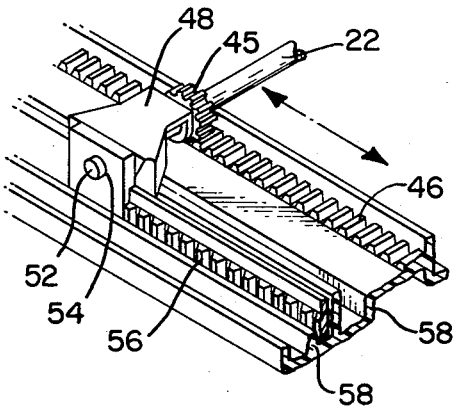
FIG. 8 is a perspective view illustrating one end of the vertically positioned rod which is provided with a gear which meshes with a rack of teeth provided in the garage, and the flexible band attached to the rod which is provided with a rack of teeth such that rotation of one of the gear wheels in response to movement of an appropriate actuating member causes the rod to move along the garage.

In similar manner, there is provided at each end of the rod 22 a gear wheel having teeth which mesh with the teeth of a continuous rack 46 provided within the cabinet 10. Loosely mounted about one end of the rod 24 is a separating element 48 which is interposed between the gear wheel 45 and the end of a flexible band 50. As illustrated in FIG. 8, the end 52 of the rod 22 passes through an opening 54 provided in the end of the band 50. The band 50 is provided with a continuous rack of teeth 56 and is housed within walls 58 provided within the cabinet 10 thus permitting the flexible band 50 in response to rotation of a gear wheel 60, as explained hereinafter.

It will be apparent from the foregoing that because the rods 22 and 24 pass through the elevator 26 in the manner illustrated in FIG. 5, it is possible by moving the rod 22 to cause the elevator 26 to move from side to side, by moving the rod 24 to cause the elevator 26 to move up and down, and by simultaneously moving the rods 22 and 24 to produce composite movements of the elevator 26. In this manner, it is possible for the child to align the elevator 26 with any of the compartments 14.

Figure 2:
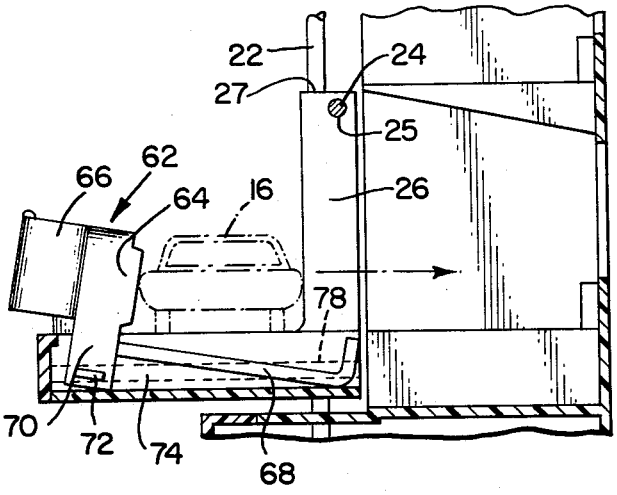
FIG. 2 is a sectional view taken along line 2—2 of FIG. 1, illustrating the position of the carrier and the loading member before the vehicle is moved into the compartment.
Figure 3:
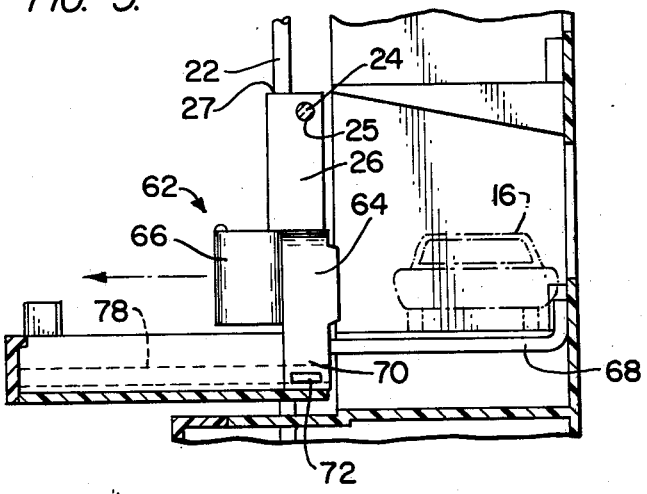
FIG. 3 is a sectional view similar to that of FIG. 2 showing operation of the unloading member to move the vehicle from the carrier into the compartment.
Figure 4:
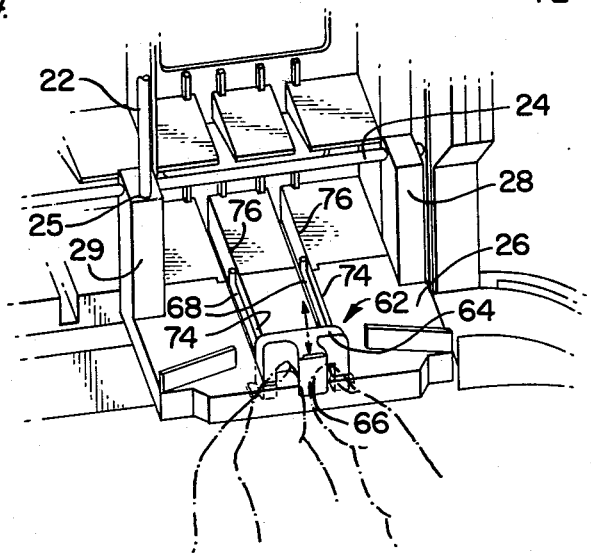
FIG. 4 is a perspective view of a portion of the toy garage illustrating the carrier positioned in front of one of the compartments and the loading-unloading mechanism.

The elevator 26 is provided with a loading-unloading mechanism 62 which, as illustrated in FIGS. 2–4, consists of a support 64 having a handle 66 extending outwardly on one side thereof and two arms 68 extending outwardly from the other side thereof. The support 64 includes downwardly extending legs 70 which are provided with outwardly extending flanges 72. The walls of the elevator 26, in turn, are provided with corresponding slots 74 into which the legs 70 of the loading mechanism 62 extend and which correspond to slots 76 provided in each of the compartments 14. The side walls defining the slots 74 of the elevator 26 are provided with openings 78 illustrated in dotted lines in FIG. 3 into which the flanges 72 extend permitting the loading mechanism 62 to be moved along the elevator 26. The openings 78 within the walls defining the slots 74 are sufficiently wide to permit the loading mechanism not only to be freely moved along the slots 74 but also to be rotated to some extent, as illustrated in FIG. 2. Thus, when one of the vehicles 16 is delivered to the elevator 26 for transportation to one of the compartments 14 it will be apparent that the arms 68 are positioned downwardly within the slots 74. To deposit the vehicle 16 within the selected compartment 14, the child depresses the handle 66 causing the arms 68 to move upwardly engaging the vehicle 16 and then pushes the handle 66 inwardly, as illustrated in FIG. 3, moving the vehicle 16 into the selected compartment 14. Thereafter, the arms 68 are lowered permitting the loading-unloading mechanism 62 to be withdrawn.

Figure 6:
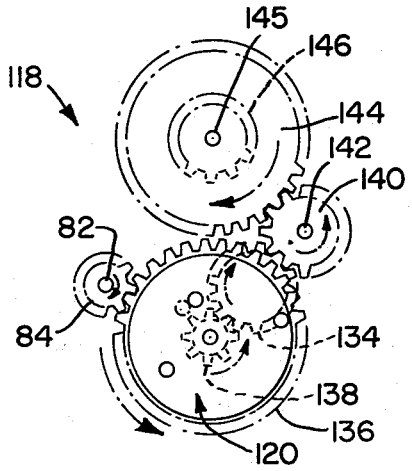
FIG. 6 is a front elevational view of the essential elements of one of the gear trains, illustrating in particular the position of the floating gear when one of the actuating members is depressed.
Figure 7:
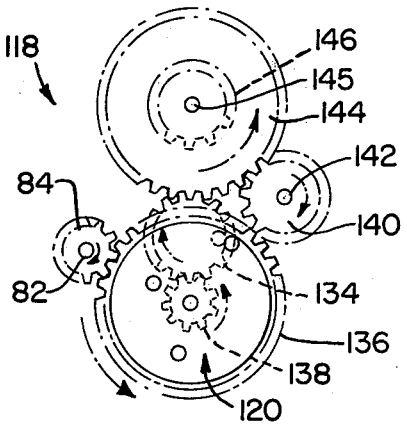
FIG. 7 is a front elevational view of the essential elements of one of the gear trains, as in FIG. 6, with the floating gear moved to a different position in response to movement of a different actuating member for purposes of reversing the rotation of the last gear of the train.

The operating mechanisms for rotating the gear wheels 44 and 60, which are responsible for moving the rods 22 and 24 and the elevator 26 secured thereto, will now be described with reference to FIG. 11 wherein the reference numeral 80 designates a chassis which is secured within the base 18. A miniature electric motor and batteries are located within the chassis 80 and appropriately wired together. Such construction is well known in the art and needs no elaboration herein. In FIGS. 5–7, the reference numeral 82 designates the shaft of the motor to which there is affixed a gear 84. Returning to FIG. 11, it will be apparent that a rod 86 is positioned within the chassis 80 and operating buttons 88, 88′, 88″, and 88‴ mounted thereto for rotation. The buttons 88, 88′, etc. extend outwardly through openings provided in the base 18, as illustrated in FIG. 1, and function to determine in which direction the elevator 26 moves as explained hereinafter. Also mounted for rotation within the chassis 80 is a lever 90, the ends 92 thereof being positioned within openings 94 provided in the chassis 80. Thus, as any of the buttons 88, 88′, etc. are depressed causing same to rotate about the rod 86, the lever 90 is moved upwardly as a result of the portions 87, 87′, etc. of the buttons 88, 88′, etc. engaging the lever 90 such that the portion 96 of the lever 90 causes the flexible electrical connector 98 to move into engagement with the other electrical connector 100 completing the circuit connecting the motor and source of energy causing the gear 84 of the shaft 82 of the motor to turn.

Figure 10:
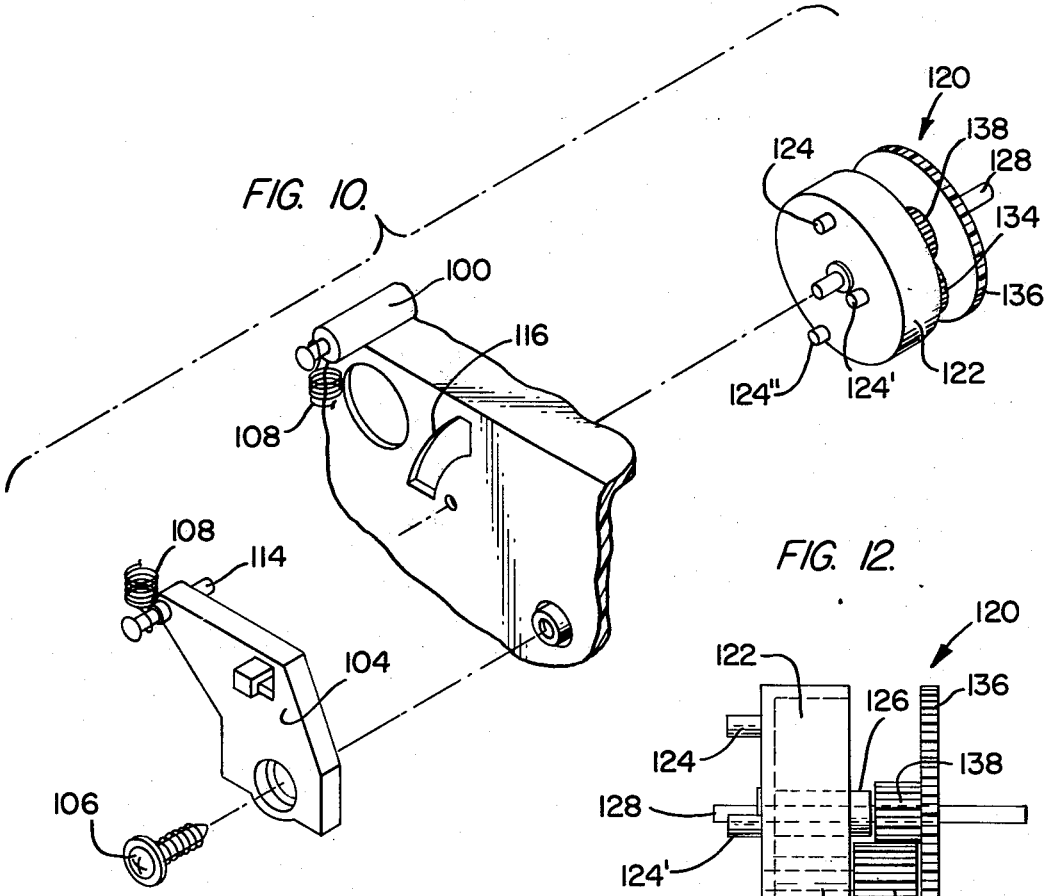
FIG. 10 is an exploded perspective view of a portion of the chassis which is located within the base of the toy garage, illustrating in particular the relationship between a rod which rotates different degrees in response to the depression of different actuating members, and its relationship to a gear assembly which is provided with multiple protrusions which position the gear assembly in a preselected position in response to the position of the rod so as to change the position of the floating gear within the train which is responsible for determining in which direction the gear wheel which meshes with the flexible band rotates.
Figure 11:
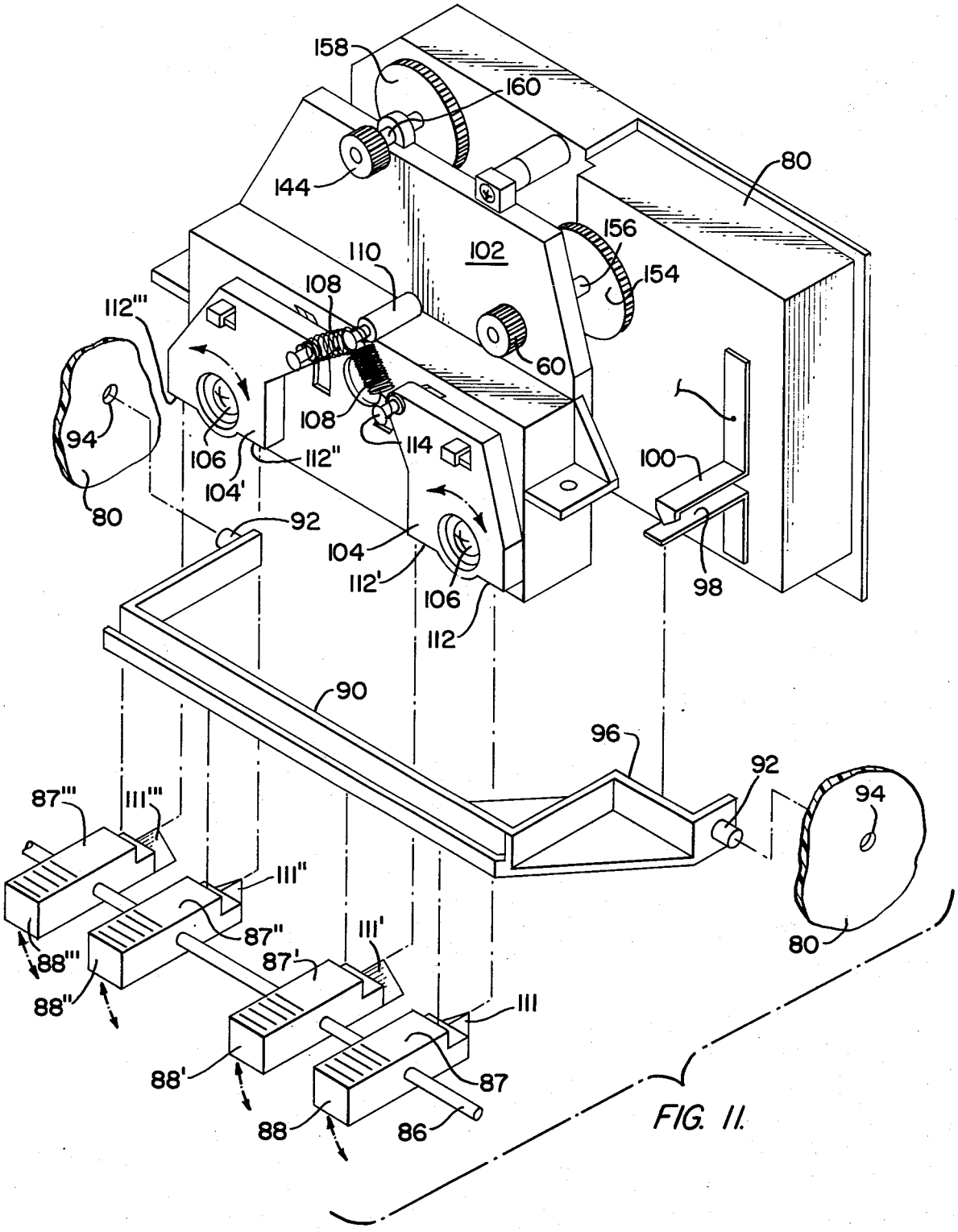
FIG. 11 is an exploded perspective view of the chassis within which certain of the operating mechanisms are located, illustrating in particular the relationship between the row of actuating members and the two rotatably mounted deflecting plates.

Appropriately mounted to the chassis 80 is a frame 102 which is provided with two deflecting plates 104, 104′ each of which is mounted to rotate about a fastener 106, and each of which is urged by a spring 108 having one end thereof attached to the deflecting plate 104, 104′ and the other end thereof attached to a post 110 into the position illustrated in FIG. 11. It will be apparent that the deflecting plates 104, 104′ are rotated by operation of the operating buttons 88, 88′, etc. since the engaging surfaces 111, 111′, etc. of the buttons 88, 88′, etc. are located immediately below the corresponding engaging surfaces 112, 112′, etc. of the deflecting plates 104, 104′ thus permitting the depressing of button 88, for example, to cause surface 111 to engage surface 112 rotating plate 104 counterclockwise. As illustrated in FIG. 10, the springs 108 are secured to the deflecting plates 104, 104′ with pins 114, 114′ that extend through openings 116 provided in the frame 102 thus permitting the pins 114, 114′ to sweep through arcs in response to actuation of the operating buttons 88, 88′.

Figure 12:
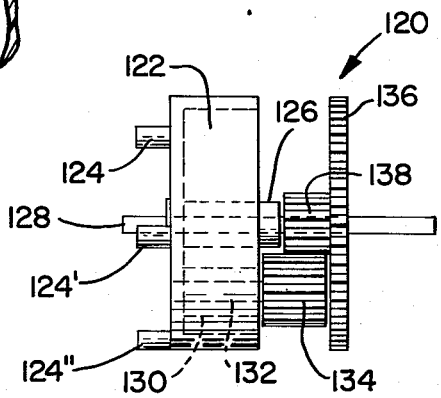
FIG. 12 is a cross-sectional view of one of the gear assemblies within which the floating gear of the train is located.

The chassis 80 is provided with two separate gear trains designated by the reference numerals 118, 118′. Each of the gear trains 118, 118′ includes a gear assembly 120, 120′, the construction of which is illustrated in FIG. 10 and 12. The gear assemblies 120, 120′ each consist of a cylindrical member 122 provided on one side thereof with posts 124, 124′ and 124″ and a hub 126 through which a shaft 128 extends. The shaft 128 is appropriately journalled for rotation in the walls of the chassis 80 and the frame 102. The cylindrical member 122 is also provided with a hub 130 into which is rotatably mounted a shaft 132 which terminates in a gear wheel 134. Also mounted on the shaft 128 is a gear wheel 136 which includes as an integral part thereof a smaller gear wheel 138 having teeth which mesh with the teeth of the gear 134. It will be apparent from the foregoing that the cylindrical member 122 and the gear wheel 134 may be rotated about the shaft 128 while the gears 136 and 138 remain stationary. The teeth of the gear wheel 136 mesh with the teeth of a gear wheel 140 which is fixedly secured to a shaft 142 which is appropriately journalled to the chassis 80 and frame 102 for rotation. The teeth of the gear wheel 140 mesh with the teeth of the gear wheel 144 which is fastened to a shaft 145 which is suitably journalled to the chassis 80 for rotation. The gear wheel 144 includes on the underneath side thereof, as illustrated in FIGS. 5 and 7, a smaller gear 146. The teeth of the gear wheel 146 mesh with the teeth of a gear wheel 148 which is mounted to a shaft 150 which is appropriately journalled for rotation between the chassis 80 and the frame 102. Secured to the shaft 150 below the gear wheel 148 is a smaller gear 152. The teeth of the gear 152 mesh with the teeth of a gear 154 which, as illustrated in FIG. 11, is secured to a shaft 156 which is journalled for rotation to the frame 102. Also attached to the shaft 156 is the gear wheel 60 which, as previously explained, is oriented to engage the rack of teeth 56 on the flexible band 50. In similar manner, the teeth of the gear 152' engage the teeth of a gear 158 which, as illustrated in FIG. 11, is mounted on a shaft 160, which is journalled to the frame 102 for rotation. At the other end of the shaft 160 is a gear wheel 44 which, as previously explained, is provided with teeth that mesh with the teeth of the rack 38 of the flexible band 36.

The springs 108 normally urge the pins 114 of the deflecting plates 104, 104' to the positions illustrated in FIG. 11, at which time the pins 114 which extend through the openings 116 engage the posts 124 thus precluding the cylindrical members 122 of the gear assemblies 120, 120' from rotating. This may be regarded as the neutral position. When the operating buttons 88 and 88'' are depressed causing the deflecting plates 104, 104' to rotate in a counterclockwise direction, as illustrated in FIG. 11, the cylindrical members 122, 122' are permitted to rotate until the posts 124' engage the pins 114, afterwhich the cylindrical members 122 remain stationary. When the operating buttons 88' and 88''' are depressed, the deflecting plates 104 are rotated clockwise about the fasteners 106, as illustrated in FIG. 11, and the cylindrical members 122, 122' are permitted to rotate until the posts 124'' engage the pins 114, afterwhich the cylindrical members 122 remain stationary. The purpose of permitting the cylindrical members 122, 122' to rotate through the positions noted above is to permit the positions of the gears 134, 134' to be changed. Thus, when the gear wheel 134 is in the position illustrated in FIG. 7, which corresponds to the depression of the operating button 88', it will be apparent that the gear wheel 134 engages the gear wheel 144 driving same in a counterclockwise direction. When the button 88 is depressed, the cylindrical member 122 assumes the position illustrated in FIG. 6, at which time the gear wheel 134 engages the gear wheel 140 which in turn engages the gear wheel 144 causing same to rotate in a clockwise direction. From the foregoing, it will be apparent that depending upon where the gear wheel 134 is positioned within the train 118 the resultant action will rotate the gear wheel 144 either clockwise or counterclockwise. Thus, depressing the operating button 88' downwardly not only energizes the motor causing the gear wheel 84 to rotate the gear wheel 136 which causes the gear wheel 138 to rotate the gear wheel 134 but in addition permits the gear wheel 134 to drive the gear 140 in turn driving the gear 144 in a clockwise direction in turn driving the gear wheel 148 and smaller gear 152 in a counterclockwise direction in turn driving the gear wheel 60 in a clockwise direction in turn propelling the flexible band 50 in direction towards the left as illustrated in FIG. 5 in turn moving the rod 22 to the left. As the operating button 88' is depressed the gear wheel 134 directly drives the gear wheel 144 in a counterclockwise direction thus reversing the direction of rotation of the gear wheel 60 in turn causing the rod 22 and the elevator 26 to move to the right.

From the foregoing it will also be apparent that the gear train assembly 118' operates in the same manner and is responsive to operation of the buttons 88'' and 88''' to drive the gear wheel 44 in opposite directions to move the rod 24 and elevator 26 up and down.

I claim:

1. An amusement device, comprising:

a cabinet provided with a plurality of openings therein, a carrier, means mounting said carrier to move up and down with respect to said cabinet and from side to side with respect to said cabinet to align said carrier with a desired one of said openings of said cabinet including a first rod passing through an opening provided in said carrier and terminating in gear wheels at each end thereof, said cabinet being provided with two racks of teeth along which gears of said first rod move, a second rod passing through an opening provided in said carrier and termining in gear wheels at each end thereof, said cabinet being provided with two racks of teeth along which said gears of said second rod move, and a control panel having first, second, third and fourth actuating members, and means operatively connecting said actuating members to said carrier to move said carrier up, down, left and right, respectively, including a first band provided with a continuous rack of teeth therein and attached to said first rod, a second band provided with a continuous rack of teeth therein and attached to said second rod, a first gear mounted to rotate and engaging said rack of teeth of said first band, a second gear mounted to rotate and engaging said rack of teeth of said second band, and means responsive to movement of said first actuating member for rotating said first gear in one direction and responsive to movement of said second actuating member for rotating said first gear in the opposite direction, and means responsive to movement of said third actuating member for rotating said second gear in one direction and responsive to movement of said fourth actuating member for rotating said second gear in the opposite direction.

2. An amusement device as in claim 1, wherein said means responsive to movement of said first and second actuating members for rotating said first gear comprises a motor, first gear train means operatively connected at one end thereof to said motor and at the other end thereof to said first gear, said first gear train means including a first gear wheel, a second gear wheel spaced from said first gear wheel, a third gear wheel engaging said second gear wheel, and a fourth gear wheel mounted to move between a first position wherein said fourth gear wheel connects said first and second gear wheels such that said first gear wheel drives said fourth gear wheel which drives said second gear wheel in one direction and a second position wherein said fourth gear wheel connects said first and third gear wheels such that said first gear wheel drives said fourth gear wheel which drives said third gear wheel which drives said second gear wheel in the opposite direction, and means for positioning said fourth gear wheel in its said first position as said first actuating member is moved and positioning said fourth gear wheel in its said second position when said second actuating member is moved.

3. An amusement device as in claim 2, wherein said means responsive to movement of said third and fourth actuating members for rotating said second gear comprises second gear train means operatively connected at one end thereof to said motor and at the other end thereof to said second gear, said second gear train means including a first gear wheel, a second gear wheel spaced from said first gear wheel, a third gear wheel engaging said second gear wheel, and a fourth gear wheel mounted to move between a first position wherein said fourth gear wheel connects said first and second gear wheels such that said first gear wheel drives said fourth gear wheel which drives said second gear wheel in one direction and a second position wherein said fourth gear wheel connects said first and third gear wheels such that said first gear wheel drives said fourth gear wheel which drives said third gear wheel which drives said second gear wheel in the opposite direction and means for positioning said fourth gear wheel in its said first position as said third actuating member is moved and positioning said fourth gear wheel in its said second position when said fourth actuating member is moved.

4. An amusement device as in claim 1, wherein said first and second rods are positioned horizontally and vertically, respectively, and are offset from each other.

5. An amusement device as in claim 1, further comprising a loading and unloading member provided on said carrier and having arms arranged to slide within openings provided in said carrier and each of said compartments of said cabinet.

6. A toy garage, comprising a cabinet provided with a plurality of openings therein, a carrier, an actuating mechanism, first and second rods to which said carrier is mounted terminating in gear wheels, said cabinet being provided with racks of teeth along which said gears of said rods move, first and second flexible bands provided with continuous racks of teeth therein attached to said first and second rods, respectively, first and second rotatably mounted gears engaging said racks of teeth of said first and second bands, respectively, and means responsive to the operation of said actuating mechanism for rotating said first and second gears in opposite directions for moving said carrier with respect to said cabinet to coincide with said openings therein.

* * * * *